US006508684B2

(12) United States Patent
Cotten

(10) Patent No.: US 6,508,684 B2
(45) Date of Patent: Jan. 21, 2003

(54) MARINE PROTECTION JACKET

(75) Inventor: Guy Cotten, Concarneau (FR)

(73) Assignee: Etablissements Guy Cotten, Tregunc (FR)

( * ) Notice: Subject to any disclaimer, the term of this patent is extended or adjusted under 35 U.S.C. 154(b) by 0 days.

(21) Appl. No.: 09/851,161

(22) Filed: May 9, 2001

(65) Prior Publication Data

US 2002/0022418 A1 Feb. 21, 2002

(30) Foreign Application Priority Data

May 9, 2000 (FR) ..... 00 05886

(51) Int. Cl.[7] ..... B63C 9/08
(52) U.S. Cl. ..... 441/107; 441/104
(58) Field of Search ..... 441/102, 104, 441/106, 107; 2/102, 108

(56) References Cited

U.S. PATENT DOCUMENTS 2,607,934 A * 8/1952 Bailhe ..... 441/107
4,023,223 A * 5/1977 Anderson et al. ..... 441/104
4,416,641 A * 11/1983 Spinosa et al. ..... 441/107
5,603,646 A 2/1997 Tobias ..... 441/94

FOREIGN PATENT DOCUMENTS

FR 1 029 851 6/1953
FR 2 374 860 7/1978

* cited by examiner

*Primary Examiner*—S. Joseph Morano
*Assistant Examiner*—Lars A. Olson
(74) *Attorney, Agent, or Firm*—Young & Thompson

(57) ABSTRACT

A marine protection jacket comprising two front flaps, a fastener on the front, which jacket can be worn over an inflatable lifejacket comprising two lungs arranged on the lateral and front portions of the user's thorax. Both front flaps are interconnected via a piece of fabric forming bellows, whereas the jacket must be slipped on as a jumper, the bellows are arranged inwardly with respect to the fastener and the fastener comprises two fastening members, the first member showing a resistance to forced opening of the flaps that is lower than that of the second member, the first fastening member being arranged toward the upper portion of the fastener and the second fastening member being arranged toward the lower portion of the fastener, the second fastening member enabling to close the jacket up to height corresponding substantially to the lower extremity of the lifejacket in order to avoid compression of the user when the lifejacket is inflated.

9 Claims, 4 Drawing Sheets

MARINE PROTECTION JACKET

FIELD OF THE INVENTION

This invention concerns a marine protection jacket. It is more particularly suited for wearing over an inflatable lifejacket.

BACKGROUND OF THE INVENTION

The maritime activities or more generally aquatic activities exhibit risks whose main one is drowning. The persons exposed to such a risk therefore generally wear lifejackets and preferably of inflatable type, which once deflated constitute small space requirements and hence reduced inconvenient and that may be worn continuously. These lifejackets are generally of automatic inflating type, whereas contact with water triggers a pressurised gas cylinder to open in the lungs of the lifejacket. These lifejackets can be simple, i.e. solely comprise the lungs and the straps intended for holding them, or still be part of a functional assembly as described in the applicant FR-00/4730. This functional assembly comprises especially a set of safety shoulder straps comprising an inflatable lifejacket.

Similarly, within the framework of these activities, the persons can be is subject to detrimental environmental or climatic conditions, for example cold, wind, sea sprays . . . These persons must therefore protect themselves against these conditions. The functional assembly of the application FR-00/4730 can be therefore particularly efficient in that respect since it is suited to trousers. However, it is often necessary that the persons should also be protected better as regards their trunks, let alone their heads. In this view, protection jackets have been suggested. The expression jacket corresponds here to any piece of clothing intended for protecting the trunk and for example a jacket properly speaking, a blouson-style jacket, an anorak, an overjacket, possibly a waistcoat . . . Still, if wearing a jacket does not raise any problems when a lifejacket worn underneath is not inflated, the situation is radically different when the lifejacket is inflated and the jacket is closed since the thorax of the person is then compressed by the lungs of the lifejacket that are constrained inside the closed jacket. The solution for the person then consists in opening the jacket so that the lungs of the lifejacket can develop freely. This calls however for the person to be conscious and able to open his/her jacket, failing which the person could choke.

SUMMARY OF THE INVENTION

This invention suggests therefore a protection jacket doing away with these shortcomings. The invention concerns therefore a marine protection jacket comprising two front flaps, a fastener on the front intended for bringing together and fastening both flaps, whereas the said jacket can be worn over an inflatable lifejacket comprising two lungs arranged on the lateral and front portions of the user's thorax.

According to the invention, both front flaps are interconnected via a piece of fabric forming bellows, whereas the said jacket must be slipped on as a jumper that is put on by slipping one's head through the neck opening, whereas the said bellows are arranged inwardly with respect to the fastener in order for the fastener to remain accessible from the outside, and in that the fastener comprises two fastening means, the first means showing a resistance to forced opening of the flaps that is lower than that of the second means, the first fastening means being arranged toward the upper portion of the fastener and the second fastening means being arranged toward the lower portion of the fastener, the second fastening means enabling to close the jacket up to height corresponding substantially to the lower extremity of the lifejacket in order to avoid compression of the user when the lifejacket is inflated, the first means being open and the second means closed up to its upper extremity.

In various embodiments of the invention, whereas the following means can be used individually or in all their technically possible combinations, are implemented:

- the resistance to opening of the first means is such that the opening takes place spontaneously as the lifejacket is being inflated,
- the first fastening means is selected among the VELCRO® fasteners or snap fasteners,
- the first fastening means is preferably VELCRO®,
- the resistance to opening is related to the type and the contact surface of the VELCRO® fasteners or the type and the number of snap fasteners,
- in case when the first fastening means is made of VELCRO®, a continuous band is implemented on each of the flaps,
- in case when the first fastening means is made of VELCRO®, a discontinuous band is implemented on each of the flaps in order to adjust the maximum fastening height of the said first means,
- the second fastening means is selected among the zip fasteners, the VELCRO® fasteners or snap fasteners,
- the second fastening means is preferably a zip fastener,
- the first fastening means and the second fastening means overlap each other partially,
- the jacket is made of an at least watertight fabric,
- the bellows are made of an at least watertight fabric,
- the jacket comprises a front flap intended for covering the fastener outwardly,
- the jacket comprises a protection hood.

BRIEF DESCRIPTION OF THE DRAWINGS

This invention will be understood better when reading an embodiment example where.

DETAILED DESCRIPTION OF THE INVENTIONS

Figure 1:
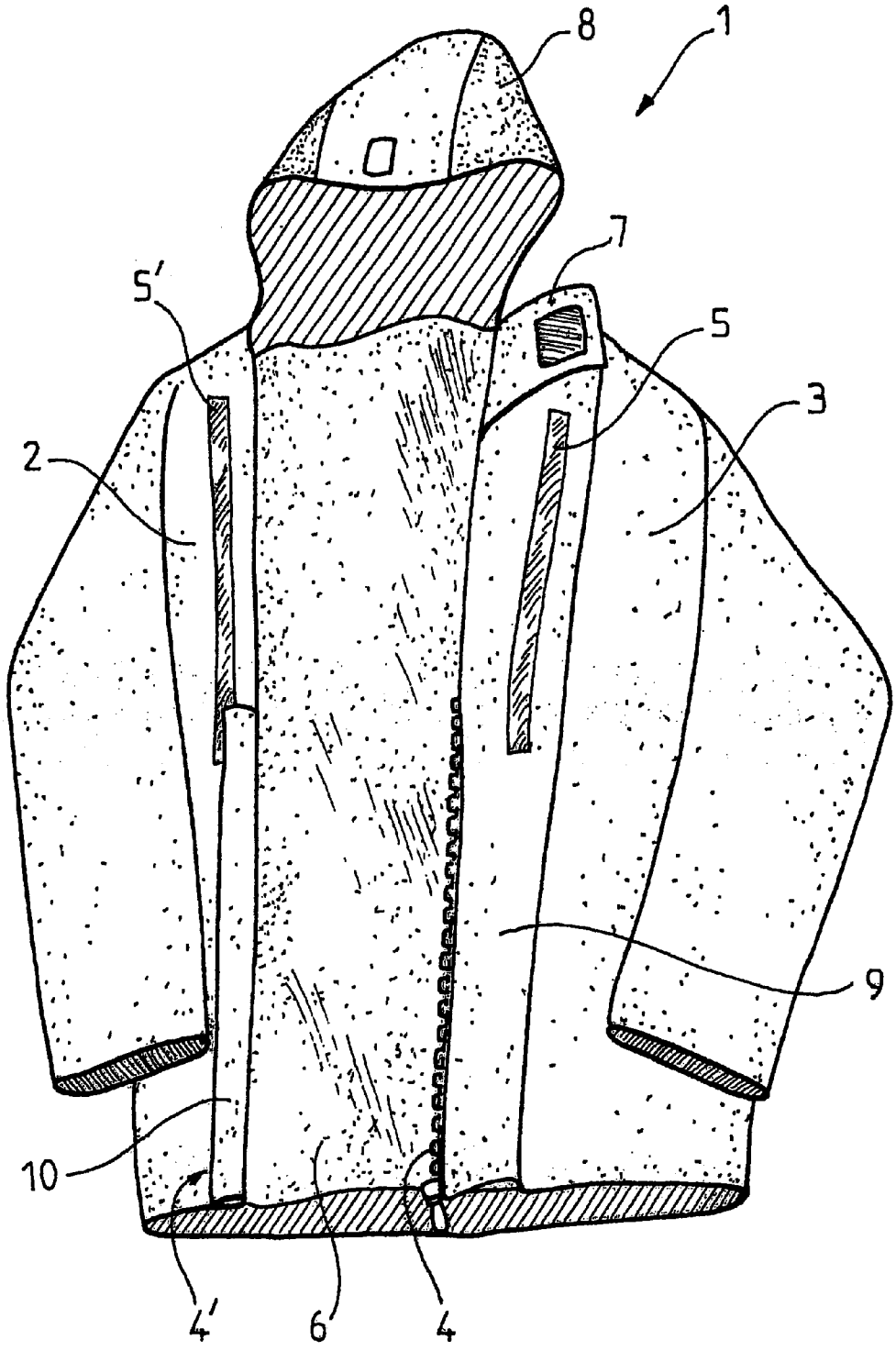
FIG. 1 shows a jacket according to the invention open completely.

On FIG. 1, the jacket 1 comprises two flaps 2 and 3 intended for being arranged on the antero-lateral portions of the user. Both users are brought together by bellows 6, which in this embodiment is an add-on piece of fabric that is fixed permanently on both flaps 2, 3 substantially parallel to their median edges. Fastening may be made by sewing, gluing or welding using any known means such as ultrasound, thermal, high frequency. In other embodiments of the invention not represented, the bellows 6 are an extension of one of both flaps 2 or 3 and that is fixed on the opposite flap or the bellows 6 correspond to the gathering and median fastening of two extensions each starting from a flap 2, 3. The jacket 1 comprises moreover a fastener intended for fastening the said jacket on a substantially median plane toward the front of the user and formed of two fastening means. The first fastening means, continuous bands 5, 5' made of VELCRO® in this example, is arranged toward the top of the jacket 1. The second fastening means, a slide fastener 4, 4' in this example, is provided toward the bottom of the jacket 1. The jacket also comprises in this example, a flap 9, a band 7 for fastening round the neck and a hood 8. On FIG. 1, the jacket is stretched to the maximum, i.e. the bellows 6 that are extended completely enable to gain approx. 35 cm at the thorax and approx. 25 cm at the abdomen with respect to the circumference when the jacket is fastened by its fastener. These figures depend obviously on size ranges defined in relation to the users that may be children as well as adults. Besides, the difference in circumference between the thorax and the abdomen is indicative and it is also contemplated that the circumferences be equal. The sizes and the form, curved or not, and/or the form of the bellows will be hence selected consequently. The bellows 6 are provided inwardly toward the user with respect to the fastener. In this embodiment example, a protection flap 10 is arranged between the means 4' of the second fastening means and the bellows 6.

Figure 2:
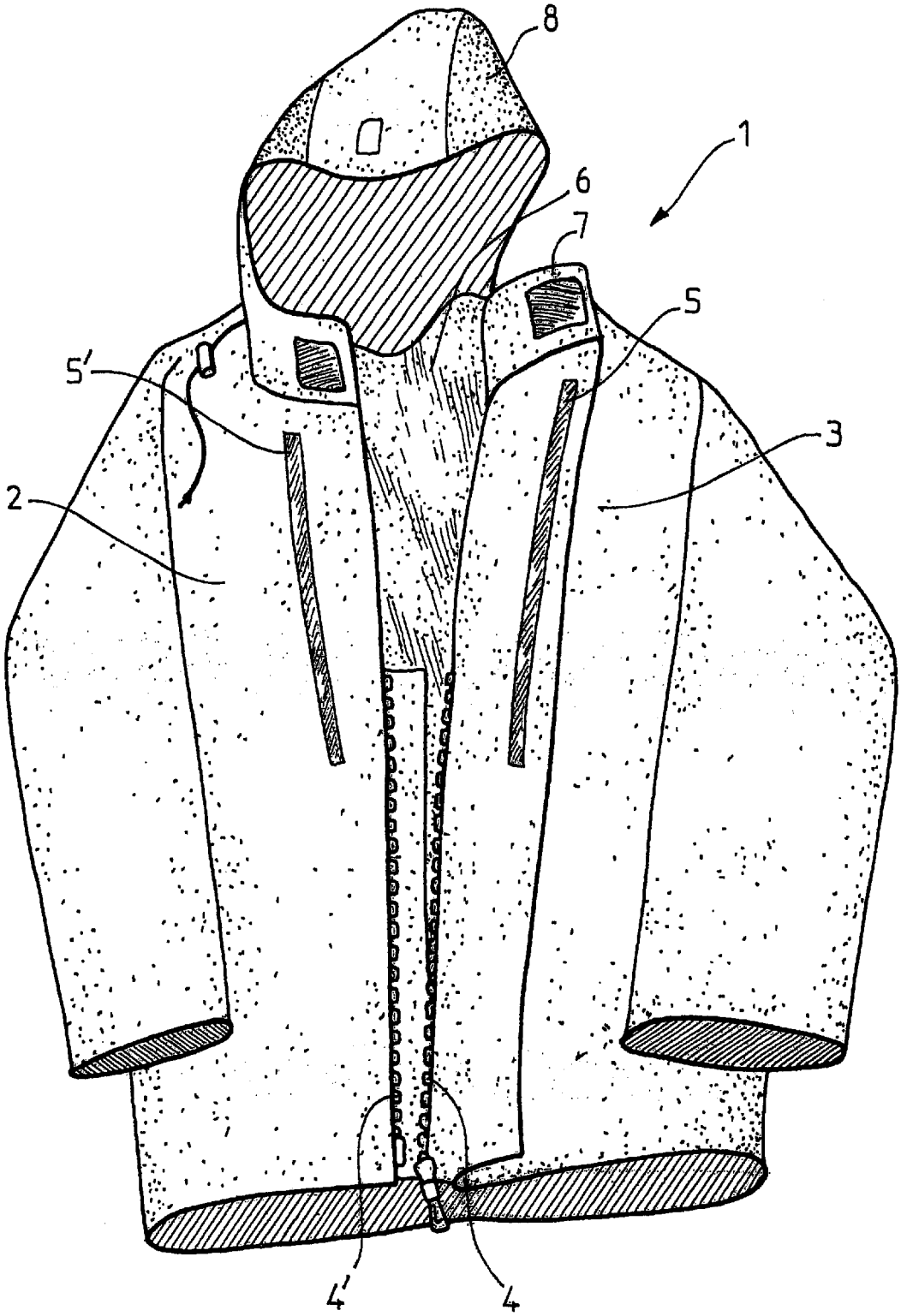
FIG. 2 shows a jacket according to the invention open partially.

FIG. 2 shows the flaps 2, 3 of the jacket 1 that have been brought sufficiently closer for the fastening to be realised. In such a configuration, the bellows 6 are folded up inside the jacket under the flaps 2, 3. VELCRO® type fastening means are implemented at the neckband to fasten it. Other fastening types are contemplated. However, the neckband fastening must have the same resistance feature as the first fastening means to be open easily and/or automatically when inflating the lifejacket.

Figure 3:
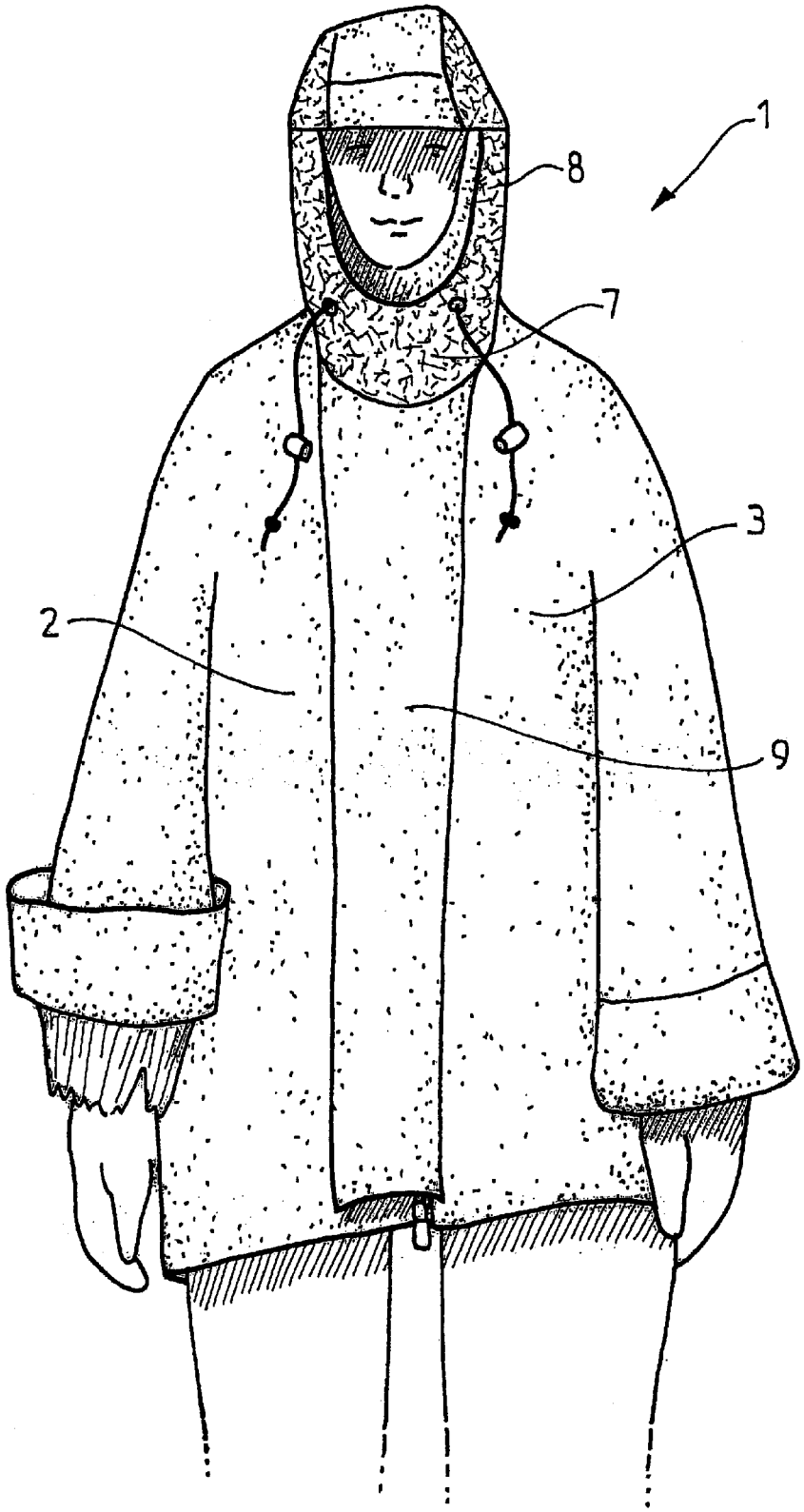
FIG. 3 shows a jacket according to the invention, closed on a user, whereas the lifejacket is not inflated.

FIG. 3 shows that the jacket 1 has been slipped around the head by a user and has been closed. The first and the second fastening means are closed and not visible on this figure, because they are covered by the flap 9. The neckband 7 is also closed. On this Figure, the user is wearing a lifejacket not inflated under its jacket.

Figure 4:
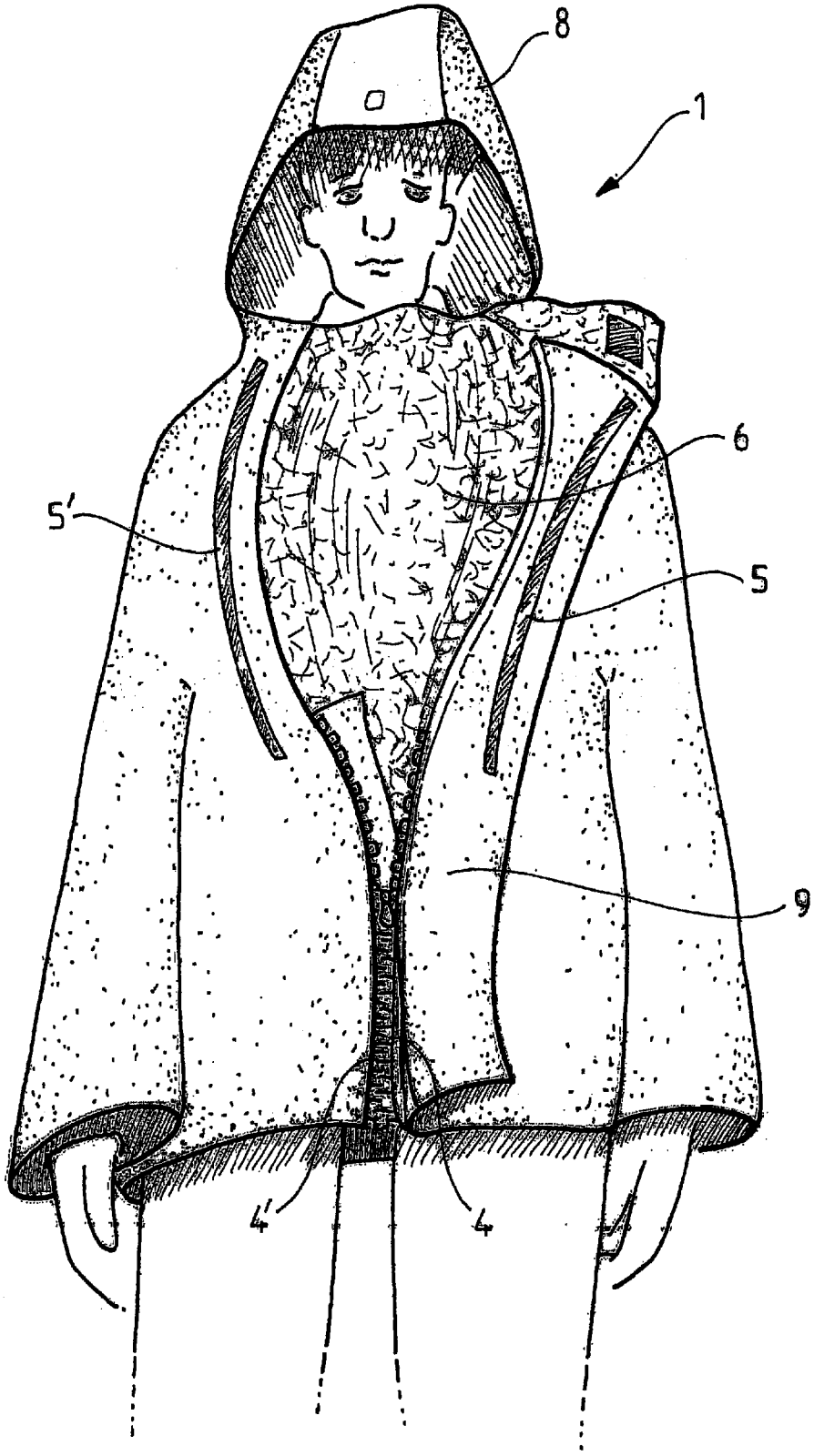
FIG. 4 shows a jacket according to the invention, closed on a user, after inflating the lifejacket.

On FIG. 4, the user's lifejacket of FIG. 3 is inflated and the upper portion of the jacket corresponding to the first fastening means is open. The first means is open manually, whereas the user manoeuvres the fastener or, preferably, automatically, the resistance to opening of the first means and of the neck band is overcome by the pressure generated by the lungs of the jacket that is inflating. FIG. 4 shows that the second fastening means is also partially open in its upper portion. In other embodiments, the position of the upper extremity of the second fastening means is such that this partial opening is not necessary.

On the other hand, although the upper extremity of the second fastening means is preferably situated substantially at the height of the lower extremity of the jacket, it is suggested that either the second means rises slightly higher, or remains slightly lower without departing from the framework of the invention. The essential feature is that the user is not compressed by the inflated jacket due to the presence of a second means that is closed totally or partially.

The materials implemented for making the jacket and the bellows 6 are preferably watertight and wind-cheating fabrics. It is also contemplated to use fabrics letting water steam through. The fabrics based on synthetic materials can be sewed, glued and/or welded.

The piece of clothing can also be made of a fabric coated with a polyamide, polyester support or other materials lending themselves to coating, calendering or impregnation or membrane pasting. These coatings can be made of PVC, PU (polyurethane), nitrile or all other materials that may be used for sealing a textile support. This piece of clothing could also be realised in a breathing, multilayer complex and the material employed can be used individually or lined.

These embodiment examples are purely indicative and it is possible to combine other conventional means with means of this invention without departing from its framework. In particular, elastic fabrics can be used possibly, other protection flaps against water and wind implemented, the VELCRO® bands 5, 5' may come down to the bottom of the jacket 1 or the flap 9 may comprise a fastening Means of such a VELCRO® type or snap fastener at its lower portion. The jacket can also be more or less long and, in the presence of sleeves, the extremities of the sleeves may comprise watertight and wind-cheating protection elastic muffs.

What is claimed is:

1. A marine protection jacket comprising a front, two front flaps, and a fastener on the front intended for bringing together and fastening both flaps, said jacket adapted to be worn over an inflatable lifejacket comprising two lungs arranged on lateral and front portions of a user's chest, wherein both front flaps are interconnected via a piece of fabric forming bellows, whereas said jacket must be slipped on as a jumper that is put on by slipping one's head through a neck opening, whereas said bellows are arranged inwardly with respect to the fastener in order for the fastener to remain accessible from the outside; said fastener comprising a first fastening means and a second fastening means; the first fastening means showing a resistance to forced opening of the flaps that is lower than that of the second fastening means; the first fastening means being arranged toward an upper portion of the fastener and the second fastening means being arranged toward a lower portion of the fastener; the second fastening means enabling to fasten the jacket up to height corresponding substantially to a lower extremity of the lifejacket in order to avoid compression of the user when the lifejacket is inflated, the first fastening means being open, and the second fastening means being closed up to its upper extremity.

2. The jacket according to claim 1, wherein the resistance to opening of the first fastening means is such that the opening takes place spontaneously as the lifejacket is being inflated.

3. The jacket according to claim 2, wherein the first fastening means is selected from the group consisting of VELCRO® fasteners and snap fasteners.

4. The jacket according to claim 1, wherein the second fastening means is selected from the group consisting of VELCRO® fasteners and snap fasteners.

5. The jacket according to claim 1, wherein the first fastening means and the second fastening means overlap each other partially.

6. The jacket according to claim 1, wherein the jacket is made of an at least watertight fabric.

7. The jacket according to claim 1, wherein the bellows are made of an at least watertight fabric.

8. The jacket according to claim 1, wherein the jacket comprises a front flap intended for covering the fastener outwardly.

9. The jacket according to claim 1, wherein the jacket comprises a protection hood.

* * * * *